US005971793A

United States Patent [19]

Jochen et al.

[11] Patent Number: 5,971,793

[45] Date of Patent: Oct. 26, 1999

[54] MULTI-CONDUCTOR CABLE CONNECTOR

[75] Inventors: Art Jochen, Norco; Roger D. Lang, Foothill Ranch; John A. C. McAllister, Lake Forest, all of Calif.

[73] Assignee: Circuit Assembly Corp., Irvine, Calif.

[21] Appl. No.: 08/873,795

[22] Filed: Jun. 12, 1997

[51] Int. Cl.[6] ..... H01R 4/24

[52] U.S. Cl. ..... 439/405

[58] Field of Search ..... 439/389, 395, 439/404, 405, 417

[56] References Cited

U.S. PATENT DOCUMENTS

| | | | |
|---|---|---|---|
| 4,027,941 | 6/1977 | Narozny . | |
| 4,068,912 | 1/1978 | Hudson, Jr. et al. | 439/405 OR |
| 4,094,564 | 6/1978 | Cacolici . | |
| 4,095,862 | 6/1978 | Hatch . | |
| 4,194,803 | 3/1980 | Hatch . | |
| 4,260,209 | 4/1981 | Zell et al. . | |
| 4,270,831 | 6/1981 | Takahashi . | |
| 4,596,428 | 6/1986 | Tengler . | |
| 4,601,527 | 7/1986 | Lemke . | |
| 4,681,382 | 7/1987 | Lockard . | |
| 4,701,139 | 10/1987 | Good et al. . | |
| 4,747,787 | 5/1988 | Siwinski . | |
| 4,762,500 | 8/1988 | Dola et al. . | |
| 4,824,384 | 4/1989 | Nicholas et al. . | |
| 4,902,243 | 2/1990 | Davis . | |
| 4,938,711 | 7/1990 | Davis et al. . | |
| 5,041,011 | 8/1991 | Chiang | 439/405 OR |
| 5,161,987 | 11/1992 | Sinisi . | |
| 5,338,221 | 8/1994 | Bowen et al. | 439/405 OR |
| 5,536,179 | 7/1996 | Olsson et al. . | |

*Primary Examiner*—Paula Bradley
*Assistant Examiner*—Daniel Wittels
*Attorney, Agent, or Firm*—Knobbe, Martens, Olson & Bear, LLP

[57] ABSTRACT

A connector for high density multi-conductor ribbon cable. The connector has a base member, a cover member and a retainer interposed therebetween. The cover member and the retainer collectively define a ribbon cable receiving area and the mating surfaces on the cover member and the retainer have indentations that urge the conductors of the ribbon cable so as to center the conductors in a conductor space defined by the indentations. A plurality of contacts are positioned in the base and an insulation displacement ends of the contacts extend through openings in the retainer into the conductors that are centered in the conductor receiving space defined by the indentations. The base member exerts force against the contacts so that compression of the cover and the base results in the conductors simultaneously being centered in the conductor receiving space and the contacts being urged into the conductors. The contacts are preferably provided attached at a first end to a carrier wherein the first end comprises a mating section and the opposite end comprises the insulation displacement end. The insulation displacement ends of the plurality of contacts are arranged so that they form two parallel lines thereby simplifying assembly of the connector.

36 Claims, 7 Drawing Sheets

MULTI-CONDUCTOR CABLE CONNECTOR

BACKGROUND OF THE INVENTION

1. Field of the Invention

The present invention relates to connectors configured to connect to multiconductor ribbon cable and, in particular, concerns a connector that is configured to connect to conductors within a high density multi-conductor ribbon cable in a more efficient and accurate manner.

2. Description of the Related Art

Ribbon cable is a type of cable which has a plurality of conductors positioned adjacent to each other in a single plane. Typically, conductors are encased in a flexible insulating material, such as vinyl, which follows the contours of the parallel, closely spaced conductors in the ribbon cable. Ribbon cable is often used to interconnect computer components. One common example of the use of ribbon cable is to connect motherboards in personal computers to disk drives. Ribbon cable is also often used to interconnect computers to accessory equipment.

Generally, connectors are used to interconnect the cables to various devices. These connectors have a plurality of contacts which are configured to contact the conductors within the ribbon cable and also to provide a pin connection to a mating connector or printed circuit board. Typically, the connector includes a plurality of contacts that have an insulation displacement end that pierces the insulation surrounding the conductor in the ribbon cable and contacts the embedded conductor, and a mating section that provides a connection point for pins of a mating connector or printed circuit board.

The typical connector is generally rectangular in shape and has an opening which receives the ribbon cable so that the connector spans the width of the ribbon cable. The insulation displacement ends of the plurality of contacts are positioned within the connector so that when the connector is closed around the ribbon cable, the insulation displacement end pierces the insulation surrounding the conductors of the ribbon cable and forms an electrical connection with each of the conductors within the ribbon cable. The contacts are preferably exactly positioned within the connector so as to be able to contact and make an electrical connection with the corresponding conductor within the ribbon cable.

However, currently available connectors for higher density ribbon cables suffer from several problems. One such problem stems from the relatively small size of the conductors and their relatively close position to each other. The tolerances between the contacts in the connector must be very exact to ensure that each contact is being connected to only its' intended conductor. However, the conductors in the cable are also prone to be slightly misaligned as a result of manufacturing tolerances. This can result in the contacts making inadvertent contact with adjacent conductors or not making adequate contact with the intended conductors. Hence, there is a need for a connector that is capable of correctly orienting the conductors with respect to the contacts to ensure better connection between the contact and the conductor.

Moreover, the contacts in the connectors that are configured to be attached to the higher density ribbon cables are generally smaller in size. One difficulty associated with these smaller contacts is that the insulation displacement ends of the contacts are more likely to bend during the attachment of the connector to the ribbon cable. As the conductors within the high density ribbon cables are closer together, this can result in the contacts making electrical connection to conductors other than the intended conductor. Further, as the conductors are positioned closer together, the tolerances in the connector are much smaller. It is important that the conductors of the ribbon cable be exactly aligned with respect to the connector to ensure that the contacts in the connector make good electrical connections to the contacts. Consequently, the higher density ribbon cable connectors that are currently available are less reliable as accurate connection between the contacts and the conductors is more problematic.

Another problem of prior art connectors is that the manufacturing and assembling cost of these connectors is relatively high. Specifically, these connectors typically use multiple rows of contacts that are positioned within the connector in a position where they can connect to corresponding conductors within the ribbon cable. For example, with the old forty conductor ribbon cable, there would be two rows of 20 contacts positioned in the connector so as to connect to the ribbon cable conductors. With the higher density ribbon cables, there is often three or four rows of contacts positioned within the connector to connect to each of the ribbon cable conductors.

The greater the number of rows of contacts in the connector increases the assembly cost of the connector. Specifically, the contacts that are positioned within the connectors are typically provided in rows that are ganged together. If the connector is configured to have more rows of contacts, then more rows of contacts must be positioned into the corresponding receptacles in the connectors. For example, a single prior art connector that connects to a ribbon cable having sixty-eight conductors spaced on 0.025" centers may have four parallel rows of contacts that are spaced on 0.100" centers so that the four separate rows of contacts make electrical contact with the conductors in the ribbon cable. This requires that the assembler of the device position four separate rows of contacts into receptacles formed in the connector during the assembly process. Moreover, there are typically only two rows of mating sections of the contacts that are positioned within the connector so as to be connected to an external connector or printed circuit board. The assembly of a connector having four rows of insulation displacement ends configured to make electrical connection with the ribbon cable, but only two rows of mating sections greatly complicates the assembly of the connector.

Further, the greater number of rows of contacts for each connector also results in a higher manufacturing cost. Specifically, each row of contacts must be plated with a conductive material such as gold. The cost of plating is highly dependent upon linear feet of material to be plated. As each row of contacts have the same length, multiplying the number of rows by four results in a four-fold increase in the plating cost of producing the contacts. Moreover, the overall cost of the connectors is also increased as a result of the greater usage of the base metal forming the contacts.

Hence, there is a need for a connector that is configured to be attached to high density ribbon cables that is less expensive and more reliable than currently available connectors. To this end, there is a need for a connector which is cheaper to manufacture and assemble and is also less likely to be damaged during the installation process in a manner that would result in contacts becoming misconnected to conductors within the high density ribbon cable.

SUMMARY OF THE INVENTION

The aforementioned needs are satisfied by the connector of the present invention which is comprised of a retainer having a plurality of openings formed therein, a cover member that is configured to be positioned adjacent the retainer so that a cable receiving area is defined between the cover member and the retainer, and a plurality of contacts wherein the plurality of contacts have a first end that is attached to a carrier so as to form a single row of first ends of the contacts and a second end which is configured to make electrical connection with the conductors of the high density ribbon cable. The retainer and the cover are configured so that the ribbon cable receiving area is comprised of conductor spaces that receive each of the conductors in the ribbon cable. The retainer and cover are further configured to urge each of the conductors into a fixed orientation in the conductor space and the retainer has an opening for each of the plurality of contacts that guides the contacts into the conductor space so that the contact makes electrical contact with the conductor positioned in the space.

In one embodiment, the mating surfaces of the retainer and the cover have indentations that match the contours of the insulation surrounding each of the conductors forming the ribbon cable. When the retainer and the cover are compressed together, the indentations engage with the contours of insulation surrounding each of the conductors so as to precisely locate the conductors in the conductor spaces. The retainer preferably has openings for each conductor space that receive the contacts and guide the contacts so that the plurality of contacts make electrical contact with all of the conductors in the ribbon cable.

In another aspect of the present invention, the retainer has openings that receive an insulation displacement end of each of the contacts. The openings are configured so that the insulation displacement ends of the plurality of contacts are confined within the openings in the retainers so that the insulation displacement ends are directed into the corresponding conductors within the ribbon cable that is positioned within the ribbon cable receiving area. Further, the surface of the retainer and the cover that define the ribbon cable receiving area are preferably contoured so as to match the contours of the insulation surrounding the high density ribbon cable.

When the insulation displacement members are inserted through the retainer into the conductors, the cover and the retainer are preferably compressed so that individual ones of the conductors are centered within the space defined by contours of the cover and the retainer while the insulation displacement ends are simultaneously urged into the space defined by the contours of the cover and the retainer. Specifically, the plurality of contacts are also positioned in a base member which urges each of the contacts so that each insulation displacement end of a contact is directed through an opening in the retainer that opens into one of the contoured spaces. Consequently, the compression of the retainer, the cover and the base results in the conductors being centered in the contoured space while simultaneously driving the insulation displacement ends of the contacts into the conductors. This helps to ensure that the insulation displacement ends of the contacts, is directed only into the appropriate corresponding conductor within the high density ribbon cable.

In one embodiment, the ends of the plurality of contacts that are positioned in the retainer so as to make contact with the conductors includes at least one tab that makes contact with the inner surfaces of the openings in the retainer. The tabs on each of the contacts are located and dimensioned so that, when the plurality of contacts are positioned in the retainer, the tabs support and stabilize the retainer during compression the ribbon cable. The tabs are either deformed or driven into the retainer material in response to the cover and the retainer being compressed together, however, the tabs stabilize the retainer during the compression of the cover and the retainer thereby facilitating the urging of the conductors into their respective fixed orientations within the spaces defined by the retainer and cover. In effect, the tabs support the retainer to thereby allow the cover to be urged against the retainer with greater force.

In another aspect of the present invention, the plurality of contacts are formed so that when the contacts are attached to the carrier they define two parallel rows of second ends that are configured to be mounted within the retainers for subsequent electrical connection to the conductors within the ribbon cable. It will be appreciated that since the contacts are initially positioned in the carrier they define two parallel rows of second ends configured to make electrical connection with the conductors in the ribbon cable, that the assembly of the connector of the present invention is simplified. In particular, the number of rows of contacts that must be positioned within the retainer or like device is reduced by one-half. Further, since a greater number of individual contacts are positioned on a single carrier, the cost of the base metal as well as the cost of plating the contacts with a conductive material such as gold is thereby reduced. The connector of the preferred embodiment also preferably includes a base that is configured to receive the first ends of the plurality of contacts once the carrier has been removed from the first end of the plurality of contacts.

In another aspect of the present invention, a method of attaching a connector to a high density ribbon cable is provided. In particular, a plurality of contacts, wherein the plurality of contacts has a first end and a second end and is arranged so that the first ends of each of the contacts are aligned in a single row and attached to a carrier and the second ends of the plurality of contacts define two separate parallel rows, is positioned within the retainer so that the two parallel rows of second ends of the plurality of contacts are positioned within openings in the retainer. The carrier attached to the first ends of the plurality of contacts is then removed and the first end of the contacts are then positioned within a base member with the base member being located on a first side of the retainer. The high density ribbon cable is then positioned adjacent a second side of the retainer and a cover is positioned adjacent the other side of the ribbon cable. Subsequently, the cover, retainer and ribbon cable are all compressed together so that the plurality of second ends of the contacts are urged through the openings in the retainer so as to displace the insulation of the conductor in a well known fashion and make electrical contact with the plurality of conductors within the high density ribbon cable.

It will be appreciated that this method of attaching a connector to a multiconductor cable is simplified in that two rows of second ends of contacts are simultaneously positioned within the retainer as a result of the first ends of the retainers being attached to a carrier so as to be aligned in a single row. In one preferred method of assembly, the retainer and the cover are configured so as to be contoured so that the ribbon cable is compressed therebetween during assembly of the connector. This preferably results in the conductors being precisely located within the spaces between the retainer and the cover to thereby facilitate accurate placement of the second ends of the plurality of contacts into selected conductors within the ribbon cable.

From the foregoing, it will be appreciated that the connector of the present invention facilitates the attachment of the connector to high density ribbon cable by more accurately locating the conductors to receive the contacts.

Further, the connector of the preferred embodiment offers greater support to the ends of the plurality of contacts that are to be connected to the conductors thereby reducing the likelihood that the second ends will be deformed during installation of the connector resulting in inaccurate connection. Lastly, the connector of the preferred embodiment also reduces the costs of manufacturing and assembling the connector. These and other objects and advantages of the present invention will become more fully apparent from the following description taken in conjunction with the accompanying drawings.

DETAILED DESCRIPTION OF THE PREFERRED EMBODIMENT

Figure 1:
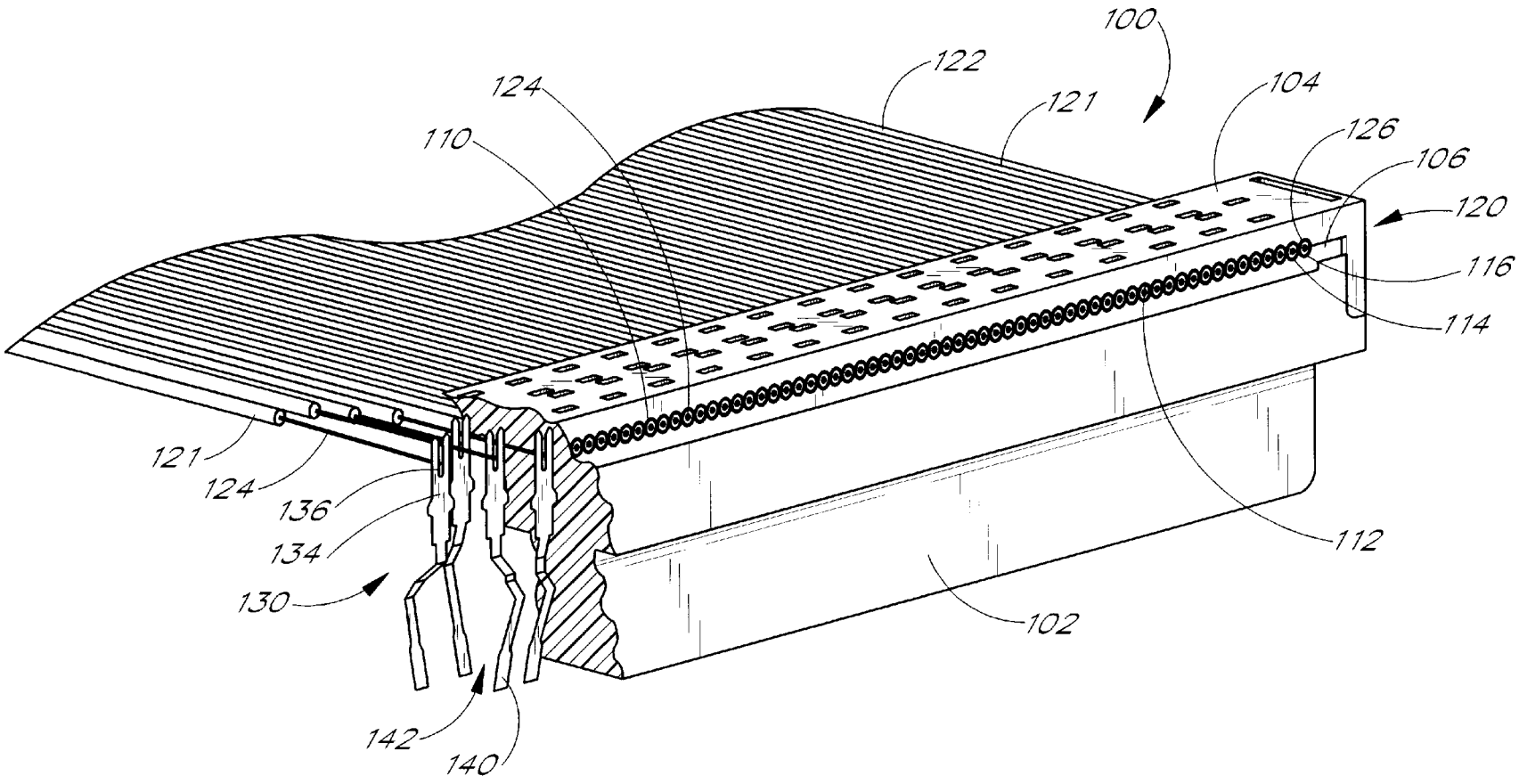
FIG. 1 is a partially cut-away perspective view of a connector of the preferred embodiment.

Reference will now be made to the drawings wherein like numerals refer to like parts throughout. Referring initially to FIG. 1, the connector 100 incorporates a base member 102 that is attached to a cover 104, in a manner that will be described herein below, and a retainer 106 that is interposed between the base member 102 and the cover 104. The cover 104 has an inner surface 110 that has a plurality of indentations 112 that are configured to receive ridges 121 of insulation surrounding each individual conductor 124 within the ribbon cable 122. Similarly, the retainer 106 also includes an inner surface 114 that has a plurality of indentations 116 that are also configured to receive the ridges 121 of the insulation surrounding the individual conductors of the ribbon cable 122. Collectively, the inner surface 110 of the cover 104 and the inner surface 114 of the retainer 106 define a receiving area 120 for the ribbon cable 122.

As will be described in greater detail below, the ribbon cable 122 is positioned within the receiving area 120 and the indentations 112 and 116 are configured to urge the ribbon cable 122 into a fixed orientation with respect to the inner surface 110 of the cover 104 and the inner surface 114 of the retainer 106. Specifically, the indentations 112 and 116 are configured so as to center each conductor 124 within a space 126 between the indentations 112 and 116. Consequently, when the ribbon cable 122 is captured between the covers 104 and the retainer 106, each of the conductors 124 within the ribbon cable 120 is fixed in the precise location with respect to the cover 104 and the retainer 106.

The typical high density ribbon cable has a plurality of conductors or wires 124 that are arranged so as to be spaced parallel to each other and surrounded by insulation. The insulation is typically a vinyl insulation that is contoured around each conductor 124 thereby forming the ridges 121 shown in FIG. 1. The insulation further provides electrical insulation between each of the conductors 124. In the preferred embodiment, the connector 100 is configured to receive high density ribbon cable which incorporates a plurality of conductors (in this example sixty eight) that are spaced on approximately 0.025" centers.

As is also shown in the partial cut-away section of FIG. 1, a plurality of contacts 130 are mounted within the base 102 in an orientation so that the contacts 130 make electrical contact with the conductors 124 and the ribbon cable 122. In this embodiment, the contacts 130 are arranged so that there are four parallel rows of insulation displacement ends that make contact with the conductors 124 and the ribbon cable 122. However, as will be described in greater detail below in reference to FIG. 9, the contacts 130 are arranged so that there are two parallel rows of mating sections 140 that are positioned within the base 102 of the connector 100.

FIG. 1 also illustrates the basic configuration of the contacts 130. The configuration of the contacts 130 will be described in greater detail below, however, FIG. 1 illustrates that the contacts 130 have an insulation displacement end 134 and a mating section 140. The insulation displacement end 134 is essentially comprised of two blades 136. The two blades 136 are configured to displace, in a well-known manner, the insulation 121 surrounding the conductors 124 in the ribbon cable 122 so that the inner surfaces of the two blades 136 make contact with the conductor 124 that is captured in thc space 126. In FIG. 1, the insulation 121 surrounding the conductors 124 has been stripped away for illustration purposes, however, it will be appreciated that the contacts 130 displace the insulation to make contact with the conductor 124 in a well known manner. Further, the mating section 140 of each of the contacts 130 extend into the base 102 of the connector 100 and is configured to be connected to a pin on an external mating connector or a printed circuit board. Specifically, as shown in FIG. 1, the mating section 140 is exposed via an opening 142 (See, FIG. 9) so that pins or pin contact members can bc positioned within the opening 142 to make electrical contact with the contacts 130. The exact configuration of the contacts 130 will be described in greater detail hereinbelow.

Figure 2:
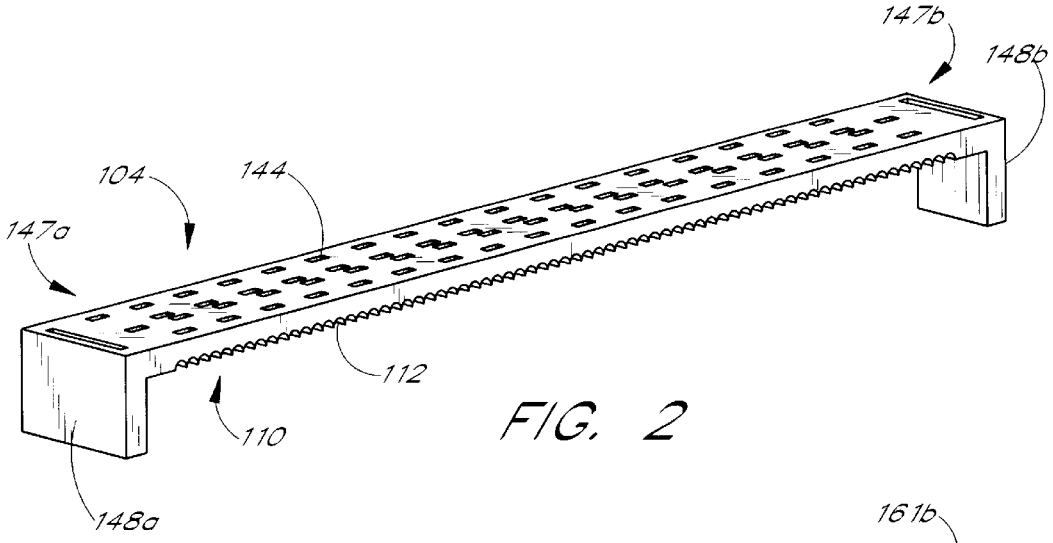
FIG. 2 is a perspective view of a cover of the connector of FIG. 1.

FIG. 2 illustrates the cover member 104 in greater detail. As shown in FIG. 1, the ribbon cable 122 is positioned along the length of the cover member 104 so that the conductors 124 within the ribbon cable 122 are preferably centered within the indentations 114 on the inner surface 110 of the cover 104.

As is shown in FIG. 2, a plurality of openings 144 are preferably formed through the cover member 104. The openings 144 are spaced to receive the blades 136 of the insulation displacement end 134 of the contacts 130. Specifically, after the blades 136 have penetrated through the insulation surrounding the conductors 124 within the ribbon cable 122, the blades 136 preferably extend into the openings 144 in the manner shown in FIG. 1. Hence, the openings 144 preferably capture the blades 136 in a space defined by the openings 144 so that the blades 136 on adjacent contacts 130 are less likely to be bent during insertion of the contacts, or by subsequent manipulation of the connector 100, to contact adjacent contacts 130. Consequently, there are four rows of openings 144 in the cover that are configured to receive the blades 136 of the insulation displacement ends 134 of the contacts 130.

At both ends 147*a* and 147*b* of the cover 104, there are two blocks 148*a* and 148*b* which extend outward from the inner surface 110 of the cover 104. The two blocks 148*a* and 148*b* are used to secure the cover 104 to the retainer 106 and the base member 102 in a manner that will be described in greater detail below.

Figure 3:
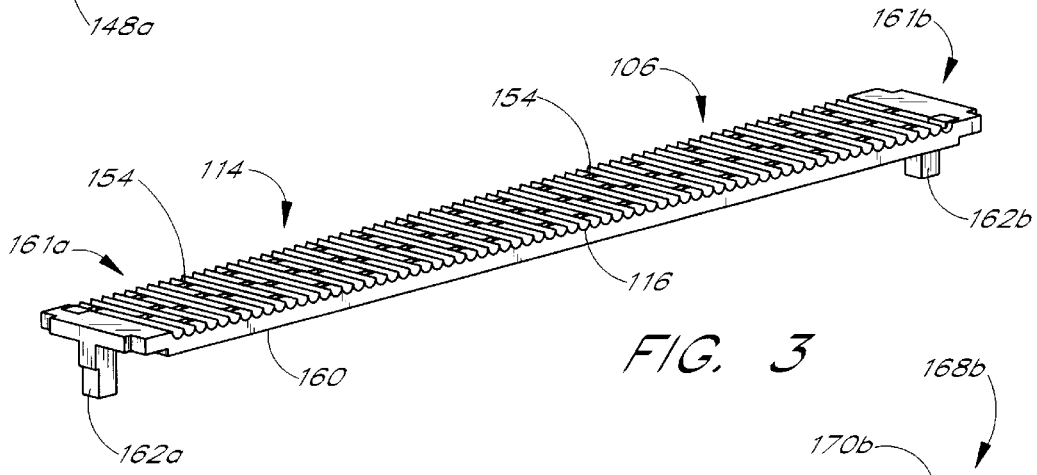
FIG. 3 is a perspective view of a retainer that is used in the connector of FIG. 1.

FIG. 3 illustrates the retainer 106 in greater detail. FIG. 3 illustrates the inner surface 114 of the retainer 106 with the indentations 116. Specifically, there are sixty-eight indentations 116 formed on the inner surface 114 of the retainer 106 in this embodiment. The retainer 106 is dimensioned so as to sit adjacent the inner surface 110 of the cover 104 in the manner that is shown in FIG. 1. As is also shown in FIG. 3, there is a plurality of openings 154 extending through the retainer 106 so that each indentation 116 has a single opening 154 formed therein. The openings 154 in the retainer 106 have the same patterns as the openings 144 in the cover member 104. Specifically, the openings 154 are configured to receive the insulation displacement ends 134 of the contacts 130 and to guide the insulation ends 134 into the appropriate space 126 to thereby make an electrical connection to an appropriate conductor 124 in the ribbon cable 122. As shown in FIG. 3, there is one opening 154 per indentation 116 on the inner surface 114 of the retainer 106. Further, the openings 154 are preferably spaced in each row 0.010" apart on center. The overall pattern of openings 154 is configured so that adjacent openings 154 in each row correspond to every fourth conductor 124 in the ribbon cable 122.

The retainer 106 ensures that the insulation displacement ends 134 of the contacts 130 are retained in their desired orientation such that the blades 136 are respectively positioned in the appropriate spaces 126 defined by the indentations 112 and 116 in the manner that is shown in FIG. 1. It will be appreciated that forcing the blades 132 through the insulation 121 on the ribbon cable 122 so as to contact each of the conductors 124 within the ribbon cable 122 requires that there be a significant amount of force exerted on the plurality of contacts 130 by the base 102. This force can result in the contacts 130 being bent so that the insulation displacement ends 134 of the contacts 130 do not make electrical contact with the corresponding conductors 124 in the space 126 but may, in fact, make unintended contact with adjacent conductors. However, the retainer 106 is configured to guide the blades 136 into the appropriate conductors 124 in the manner that will be described in greater detail in reference to FIGS. 7A–7C.

As is also shown in FIG. 3, two posts 162*a* and 162*b* extend from the ends 161*a* and 161*b* of an outer surface 160 of the retainer 106. The posts 162*a* and 162*b* are used to secure the retainer to the base 102 with the cover 104 secured to the retainer 106 in the manner that will be described in greater detail below in reference to FIGS. 7A–7C.

Figure 4:
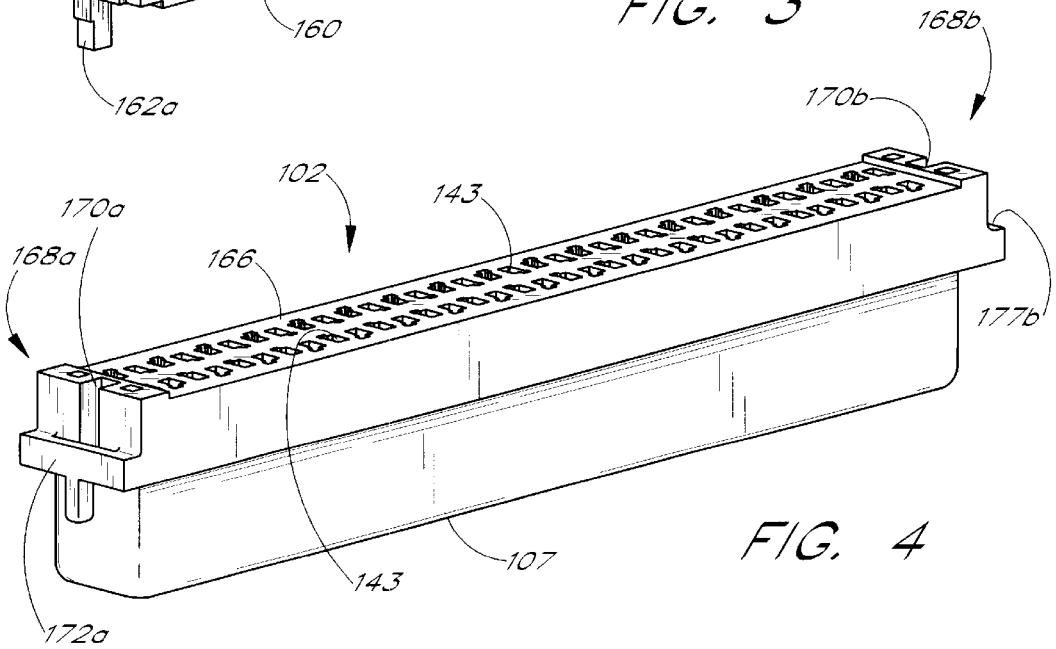
FIG. 4 is a perspective view of a base member of the connector of FIG. 1.

The base 102 of the connector 100 is illustrated in FIGS. 4 and 7A–7C. Specifically referring to FIG. 4, an inner surface 166 of the base of the connector 100 is shown. There are two parallel rows of openings 143 that are formed on the inner surface 166 of the base 102. The openings 143 in this embodiment are generally rectangular in shape and are configured to receive the mating sections 140 of each of the contacts 130. Specifically, the mating sections 140 of the contacts 130 extend upward into the openings 143 into the interior of the base 102 and are preferably configured to receive pin contacts from mating connectors, mating printed circuit boards, or any other device that is used to interconnect the ribbon cable connectors via the opening 142 (FIG. 9) on the outer surface 107 of the base 102. As is shown in FIG. 4, there are two rows of thirty-four openings that provide access to the mating sections 140 of the sixty-eight contacts 130. It will be appreciated, however, that the exact configuration and placement of the openings 143 can vary depending upon the implementation of the connector 100.

As is also shown in FIG. 4, both ends 168*a* and 168*b* of the base member 102 of the connector 100 include a coupling groove 170 and a latching member 172 that is positioned the sides of the base member 102. The coupling groove 170 is configured to receive the posts 162*a* and 162*b* of the retainer 106 to retain the retainer 106 so that the surface 160 of the retainer 106 is positioned adjacent the surface 166 of the base 102 in a well-known manner. Similarly, the outwardly extending members 172*a* and 172*b* are also configured to mate with the blocks 148*a* and 148*b* of the cover 104 so as to retain the inner surface 110 of the cover 104 adjacent the inner surface 114 of the retainer 106 in a well-known manner. It will be understood that the exact mechanism for securing the base 102, the cover 104 and the retainer 106 together in the manner shown in FIG. 1 can be any of a number of well-known methods of securing components of connectors together without departing from the spirit of the present invention.

FIGS. 5A–5C and FIGS. 6A–6C illustrate the configuration of the plurality of contacts 130 in greater detail. As shown in FIG. 1A, the plurality of contacts 130 are initially attached to a carrier 180. Specifically, a first end 182 of the mating sections 140 of each of the plurality of contacts 130 is connected to the carrier 180. The connection between the carrier 180 and the first end 182 of the mating section 140 is preferably perforated to allow for easy removal of the carrier 180 from the plurality of contacts 130 in the manner that will be described in greater detail below. The plurality of contacts 130 are preferably formed out of a conductive material using well known techniques and are also preferably coated with a conductive material, such as gold, in a well known manner.

The mating section 140 is elongate and is configured so as to extend inward into the base 102 of the connector 100 so as to be accessible by external contacts in a manner that will be described hereinbelow in reference to FIG. 9. In this embodiment, the mating section 140 includes a bent section 185 that is interposed between the first end 182 and the second end 184 of the mating section 140. A second end 184 of the mating section 140 of the each of the contacts 130 is connected to a central section 186 on each of the contacts 130. The central section 186 is wider than the second end 184 of the mating section 140 so that a lip 190 is defined at the interface between the mating section 140 and the central section 186 of the contact 130.

The central section 186 includes the lower neck portion 156 and an upper neck portion 192 that is separated by a chamfer 194. The chamfer 194 extends outward from the lateral edges of the central section 186 so as to be wider than lower and upper neck portions 156 and 192. The edges 195*a*, 195*b* of the chamfer 194 adjacent the neck portions 156 are preferably angled to thereby facilitate positioning of the chamfer 194 into appropriate openings in the retainer 106 and the base 102. The chamfer 194 is used to securely position the central section 186 of the contact 130 in both the retainer 106 and the base 102 in a manner that will be described in greater detail below.

Figure 5A:
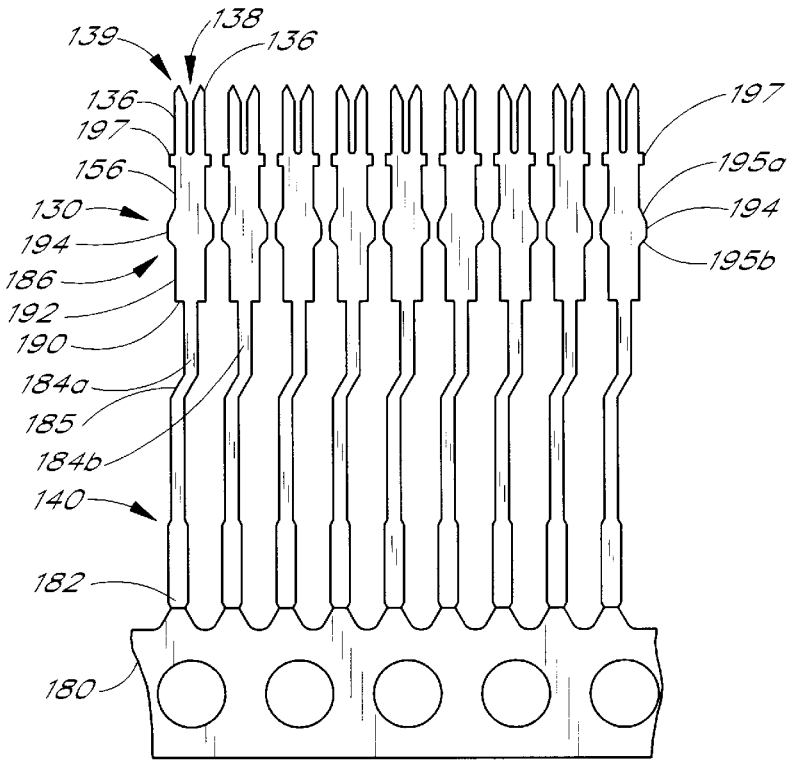
FIGS. 5A–5C are isometric illustrations of a plurality of contacts positioned within a carrier member that comprise a portion of the connector of FIG. 1.

The two blades 136 extend out from the lower neck portion 156 of the central section 186 in the manner that is shown in FIG. 5A. The two blades 136 are spaced apart so as to define a space 138 that is preferably sized so that when a conductor 124 in the ribbon cable 122 is positioned between the two blades 136 in the manner shown in FIG. 1, the inner edges of both of the blades 136 make physical contact with the conductor 124. The outer tips 139 of the blades 136 are preferably tapered so thereby facilitate positioning of the conductor 124 in the space 138.

FIG. 5A also illustrates that a lateral tab 197 is formed on the outer edges of the two blades 136 of each of the contacts 130. The lateral tabs 197 extend outward from the outer edge of the two blades 136 a distance that is slightly less than the distance that the chamfer 194 extends outward from the edges of the central section 186 of the contact 130. The lateral tabs 197 are used to stabilize the retainer 106 during attachment of the cover 104 and compression of the multi-conductor cable 122 in a manner that will be described in greater detail below in reference to FIG. 8B.

Figure 5B:
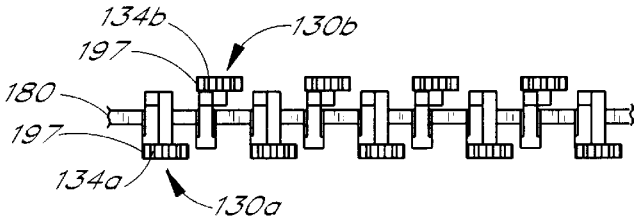
Figure 5C:
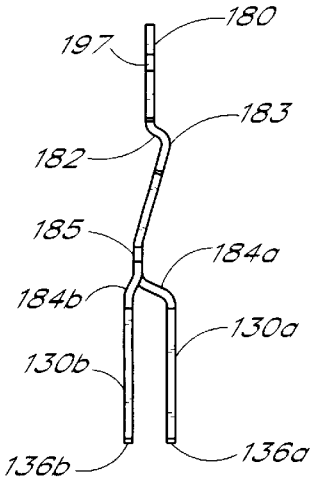

FIGS. 5B and 5C illustrate one particularly unique aspect of the plurality of contacts 130. Specifically, in a single row of contacts 130, the insulation displacement ends 134 of adjacent contacts 130*a* and 130*b* are offset from an axis that is defined by the carrier 180 to form two parallel rows of insulation displacement ends 134*a* and 134*b*. Specifically, referring to FIG. 5B, the insulation displacement end 134*a* of one contact 130*a* is positioned below the axis defined by the carrier 180 and the insulation displacement end 134*b* of the next adjacent contact 130*b* is positioned above the axis that is defined by the carrier 180. However, the mating sections 140 of each of the contacts 130 are connected to the carrier 180 so that the mating sections 140 are arranged in a single parallel row as shown in FIGS. 5B and 5C. In the preferred embodiment, there are two parallel rows of seventeen insulation displacement ends 134 of the contacts 130 and a single row of thirty-four mating sections 140 attached to a single carrier 180. This configuration of the plurality of contacts 130 simplifies the assembly of the connector 100 of the preferred embodiment as will be described hereinbelow.

FIGS. 5C and 6A–6C illustrate the configuration of each individual contact 130 of the plurality of contacts in greater detail. Specifically, as shown in FIG. 5C, the first end 182 of the mating section 140 of the contact 130 bend in a first direction at the attachment point to the carrier 180 to define a contact face 183. The contact face 183 preferably is the portion of the contact 130 to which an external connector will interface to make electrical connection to the conductor 124 in the ribbon cable 122. The mating section 140 is then angled in a second direction until it reaches the bent section 185 of the contact 130. As will be described in greater detail below, this results in the first end 182 which defines the contact face 183 being biased inward, into the opening 142 in the base 102 that is to receive the pins or connectors from an external connector.

Each of the contacts 130 have the above described contact face 183 configuration, central section 186 configuration and insulation displacement end 134 configuration. However, the second end 184*a* and 184*b* of the mating sections 140 of the contacts 130*a* and 130*b* are configured differently to position the insulation displacement ends 134*a* and 134*b* in the two separate parallel rows shown in FIG. 5B. In particular, the second end 184 of the mating section 140 of the contact 130 has two configurations as shown in FIGS. 5C, 6B and 6C.

Figure 6A:
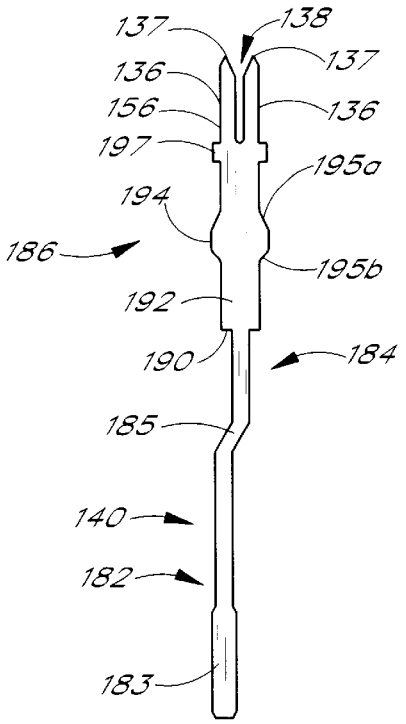
FIGS. 6A–6C are isometric views further illustrating one of the plurality of contacts shown in FIGS. 5A–5C.
Figure 6B:
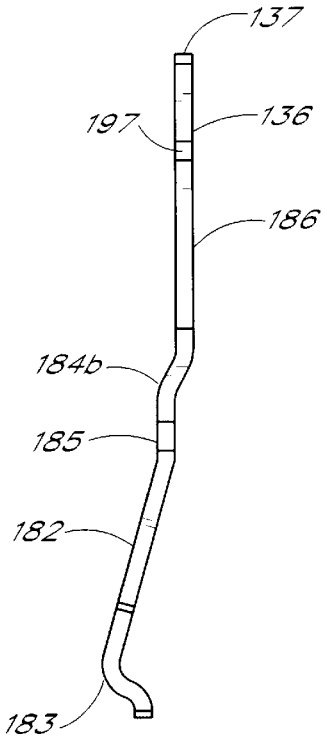
Figure 6C:
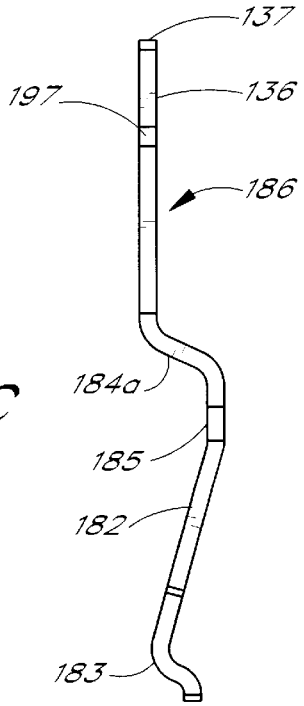

Referring to FIG. 6B, the second end 184*b* of the contact 130*b* is bent slightly in the first direction and is then mated to the central section 186 of the contact 130. The first direction, in this embodiment, is in the direction away from the face 183 of the mating section 140 of the contact 130. In contrast, as shown in FIG. 6C, the configuration of the second end 184*a* on the contact 130*a* is bent in the opposite second direction towards the face 183 so that the contact 130*a* is spaced apart from the contact 130*b* in the manner shown in FIG. 5C. The configuration of the central sections 186 of the contact 130 is substantially the same regardless of the configuration of the second end 184 of the mating section 140 of the contact 130.

The two configurations of the second end 184*a*, 184*b* of the mating section 140 of the contact 130 results in the central section 186 of the contacts 130 being positionable into the two adjacent parallel rows of openings 154 in the retainer 106 (See, FIG. 3). Hence, the configuration of the plurality of pins 130, when attached to the carriers 180, results in a single row of mating sections 140 and two spaced rows of insulation displacement ends 134. The two rows of insulation displacement ends 134 can be positioned into two rows of spaced apart openings 154 in the retainer 106 to thereby allow the insulation displacement ends 134 to make electrical connection to the conductors 124 of the ribbon cable 122.

Figure 7A:
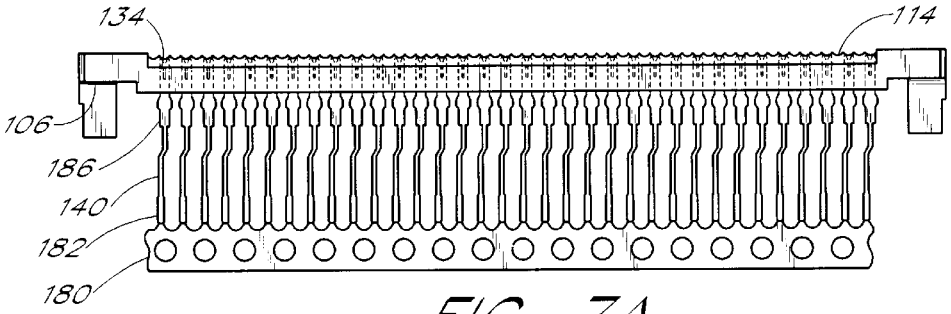
FIGS. 7A–7C are isometric illustrations illustrating the attachment of the connector of FIG. 1 to a ribbon cable.
Figure 7B:
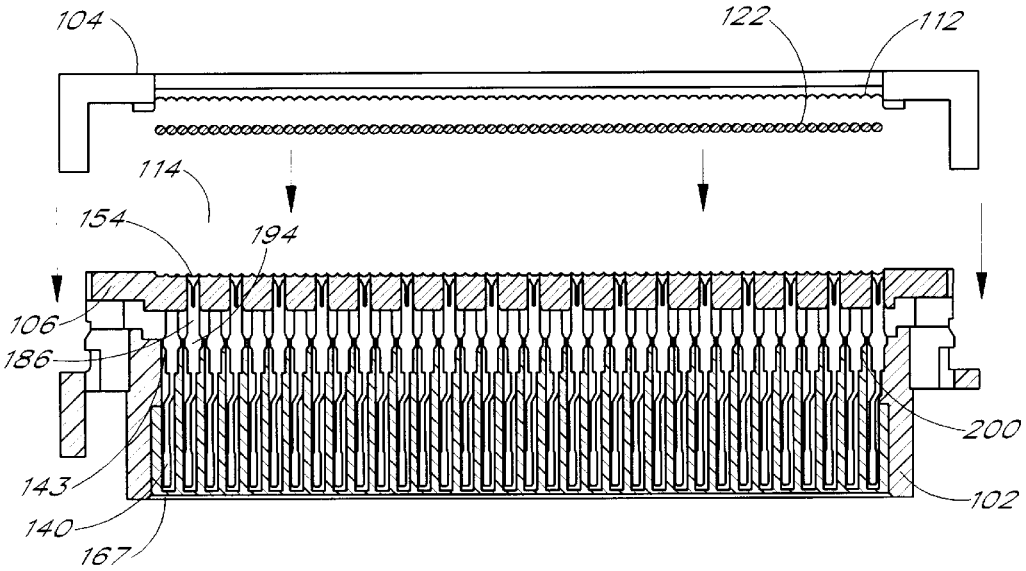
Figure 7C:
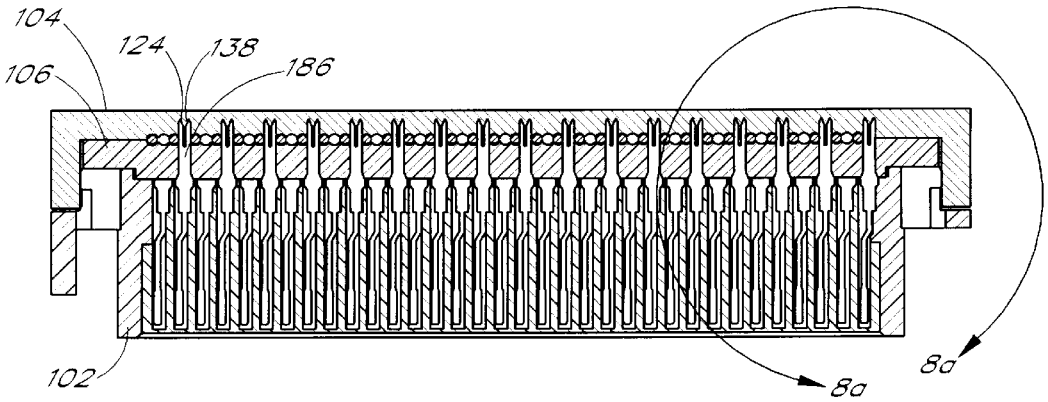

Referring to FIGS. 7A–7C, the assembly of the connector 100 of the preferred embodiment will be described in greater detail. In particular, referring to FIG. 7A, a first plurality of contacts 130 that are connected to a carrier 180 are initially positioned so that seventeen of the contacts 130 are positioned within the first row of openings 154 in the retainer 106 (FIG. 3) and a second row of seventeen contacts 130 are positioned within a second row of seventeen openings 154 in the retainer 106. A second plurality of thirty-four contacts 130 (not shown in FIG. 7A) attached to a carrier 180 which are substantially identical to the first plurality are also positioned within the other two rows of openings 154 in the retainer 106. Preferably, the central sections 186 of each of the contacts 130 are positioned within the openings 154 so that the insulation displacement ends 134 are positioned substantially adjacent the inner surface 114 of the retainer 106 in the manner shown in FIG. 7A and 7B.

The carrier 180 is then removed from the first end 182 of the contact end 140 of each of the plurality of conductors 130. As described above, the interface between the carrier 180 and the mating section 140 is preferably scored or otherwise weakened to allow the carrier 180 to be easily removed from the ends 182 of the mating section 140 of the contacts 130. The mating sections 140 of the plurality of contacts 130 are then positioned within the openings 143 in the face 166 of the base 102. As shown in FIG. 4, there are two parallel rows of thirty-four openings 143 each of which are configured to receive the mating sections 140 of the plurality of contacts 130. As shown in FIG. 7B, the openings 143 in the base 102 are preferably configured so that the central section 186 of each of the plurality of contacts is positioned within the openings 166 so that the chamfer 194 is contacting an upper surface 200 of the openings 143. The configuration and purpose of the surface 200 will be described in greater detail in reference to FIGS. 8A and 8B below.

Once the contact ends 140 are positioned within the base 102, the ribbon cable 122 is then positioned adjacent the inner surface 114 of the retainer 106 and the cover 104 is positioned adjacent the ribbon cable 122 in the manner that is shown in FIGS. 7B and 7C. In particular, each of the indentations 112 on the inner surface 110 of the cover 104 and the indentations 116 on the inner surface 114 of the retainer 106 align when the cover 104 is positioned on the retainer 106 so as to center each of the conductors 124 within the conductor space 126 defined by the indentations 112 and 116. Specifically, the insulation 121 surrounding each of the conductors 124 is preferably made of a material such as vinyl which is somewhat flexible. Compression of the retainer 106 against the cover 104 results in the indentations 112, 116 moving each conductor 124 with respect to its neighbor so that each conductor 124 is preferably centered within the spaces 126 when the retainer 106 and the cover 104 are positioned together. It will be appreciated that the cover 104 and the retainer 106 are precisely dimensioned so that the indentations 112 and 116 form circular conductor spaces 126 to center the insulation coated conductors.

The compression of the retainer 106 and the cover 104 and the base 102 together also results in the base 102 exerting force against the lip 190 of the central section 186 of the contacts 130 and also against the chamfer 194 of the contacts 130 to thereby urge the contacts into the space 126. Consequently, the blades 136 are preferably guided by the openings 154 into the conductor spaces 126 by this compression so that the conductor 124 can be captured in the space 138 between the blades 136 in the manner that is shown in FIG. 7C. The configuration of the base 102 and its interaction with the plurality of contacts 130 will be described in greater detail in reference to FIGS. 8A and 8B.

Since the upper neck section 156 of the contacts 130 is captured within the openings 154 of the retainer 106 during the compression process, the tendency of the insulation displacement end 134 to bend as a result of the compression and insertion into the insulation 121 of the ribbon cable 122 is reduced. Hence, the connector 100 is simultaneously centering the ribbon cable 122 in the openings 126 while urging the insulation displacement ends 134 into the space 126.

Figure 8A:
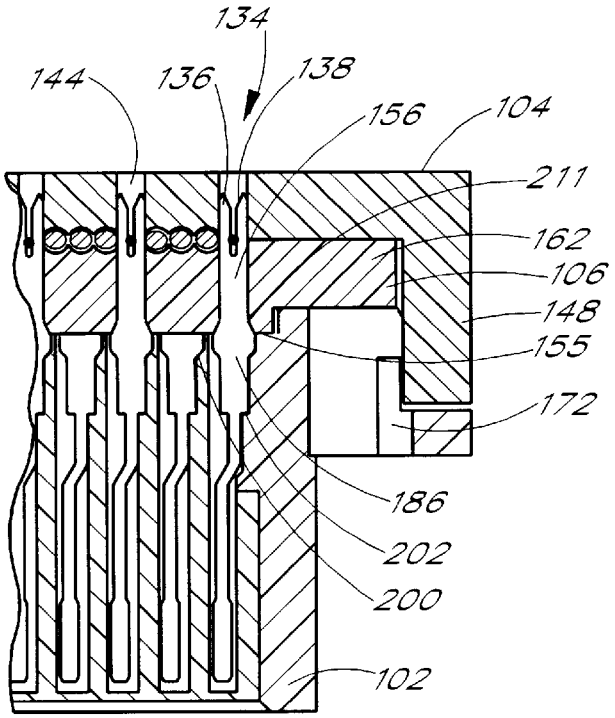
FIG. 8A is a sectional view of the connector of FIG. 1 illustrating the attachment of the plurality of contacts to the conductors of the high density ribbon cable.

FIG. 8A illustrates the positioning of the plurality of contacts 130 in the base member 102, the retainer 106 and the cover 104 in greater detail. Specifically, the insulation displacement ends 134 extend outward from the inner surface 114 of the retainer 106 so as to make electrical contact with the conductors 124 and the ribbon cable 122. The blades 136 extend through the insulation 121 into the openings 144 that are formed in the cover 104. This helps to ensure that the blades 136 do not become bent as a result of the insulation displacement process or subsequent movement of the connector so as to make unwanted contact with adjacent conductors 124 or contacts 130. The upper neck portion 156 of the central section 186 of the contacts 130 are each positioned within the openings 154 of the retainer 106. As discussed above, this helps to ensure that the insulation displacement end 134 of each contact is correctly positioned into the opening 126 defined by the indentations 112 and 116 on the inner surface of the cover 104 and retainer 106, respectively.

Figure 8B:
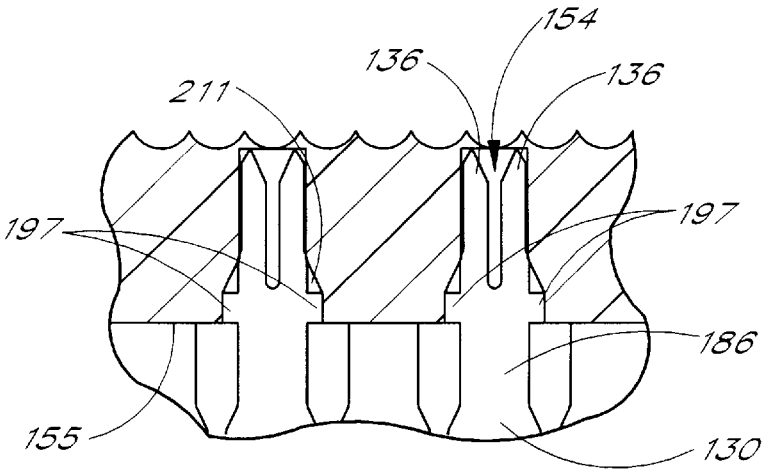
FIG. 8B is a sectional view of the connector of FIG. 1, illustrating one preferred configuration of the contacts of the preferred embodiment during attachment of the connector to the multi-conductor ribbon cable.

As shown in FIG. 8B, the opening 154 in the retainer 106 has a flanged section 211 at an outer surface 155. The tabs 197 engage with inner surface of the flanged section 211, in the manner shown in FIG. 8B to stabilize the retainer 106 during the insertion process. Specifically, the tabs 197 engage with the inner surface of each of the flanged sections 211 of the openings 154 in the retainer 106 once the retainer 106 has been positioned on the contacts 130 in the manner that is shown in FIGS. 7A and 7B above. As the tabs 197 are positioned on the same location on each contact 130, the tabs 197 serve to correctly orient the retainer 106 during the insertion process.

Subsequently, when the cover 104 is positioned on the retainer 106 and the ribbon cable 122 is compressed therebetween, the tabs 197 provide some resistance against the compression of the cover 104 against the ribbon cable 122 to increase the compressive forces against the ribbon cable 122 to thereby better urge the conductors 124 within the ribbon cable 122 into the desired orientation within the spaces 126 defined by the inner surfaces of the cover 104 and the retainer 106. The tabs 197 are configured to either deform or be forced into the material forming the retainer 106 as the compression continues to allow the contacts 130 to be inserted through the openings 154 in the retainer 106 and make electrical contact with the conductors 124 of the ribbon cable in the manner that is shown in FIG. 7C and is described in greater detail below.

Further, as is also shown in FIG. 8A, the flanged section 211 of the openings 154 is also configured to receive the portion of the chamfer 194 on the plurality of contacts that are adjacent the neck 156 of the contact 130. This helps to ensure that the contacts 130 are not over inserted into the conductors 124 of the high density ribbon cable 122. The openings 143 on the inner surface 166 of the base 102 also have a flanged section 212 that is adapted to receive the portion of the chamfer 194 on the contacts 130 that is positioned adjacent the upper neck section 192 of the central section 186.

The openings 142 in the base 102 also have a protrusion which extends laterally into the openings 143 so as to form a stop 202 in each of the openings 143 that engages the lip 190 on the contact 130. Hence, once the mating sections 140 of the contacts 130 are positioned within the openings 143 of the base 102, compression of the base 102 towards the cover 104, with the retainer 106 and the ribbon cable 122 interposed therebetween, results in the lip 200 and the stop 202 urging the insulation displacement end 134 of the contact 130 into the space 126. It will be appreciated that a relatively significant amount of force is typically required to force the insulation displacement ends 134 of each of the contacts 130 into the conductors 124 in a high density ribbon cable 122 especially in light of the resistance provided by the tabs 197 engaging with the inner surfaces of the flanged section 211 of the openings 1544 in the retainer 106. The lip 200 and the stop 202 provide the surfaces that force the contacts 130 through the insulation 121 surrounding the conductors 124 to thereby make good electrical contact with the conductors 124. Hence, the base 102 is configured, during compression of the base 102 and the cover 104, to urge the plurality of contacts 130 in a first direction that is normal to the plane of the inner surface 166 of the base 102. The base 102 therefore urges the plurality of contacts 130 through the openings 154 in the retainer 106 while the retainer 106 ensures that the plurality of contacts 130 are urged in the first direction into the conductors 124 centered within the spaces 126.

FIG. 8A illustrates that the blocks 148 on the cover 104 engage with the posts 162 of the retainer 106 and the lip 172 of the base 102 to thereby secure the cover 104 to the base 102 with the retainer 106 and the high density ribbon cable 122 captured therebetween. It will be appreciated that securing the cover 104 to the base 102 after attachment of the connector 100 to the ribbon cable 122 can be accomplished in any of a number of manners that are well known in the ribbon cable connector industry without departing from the present invention.

Figure 9:
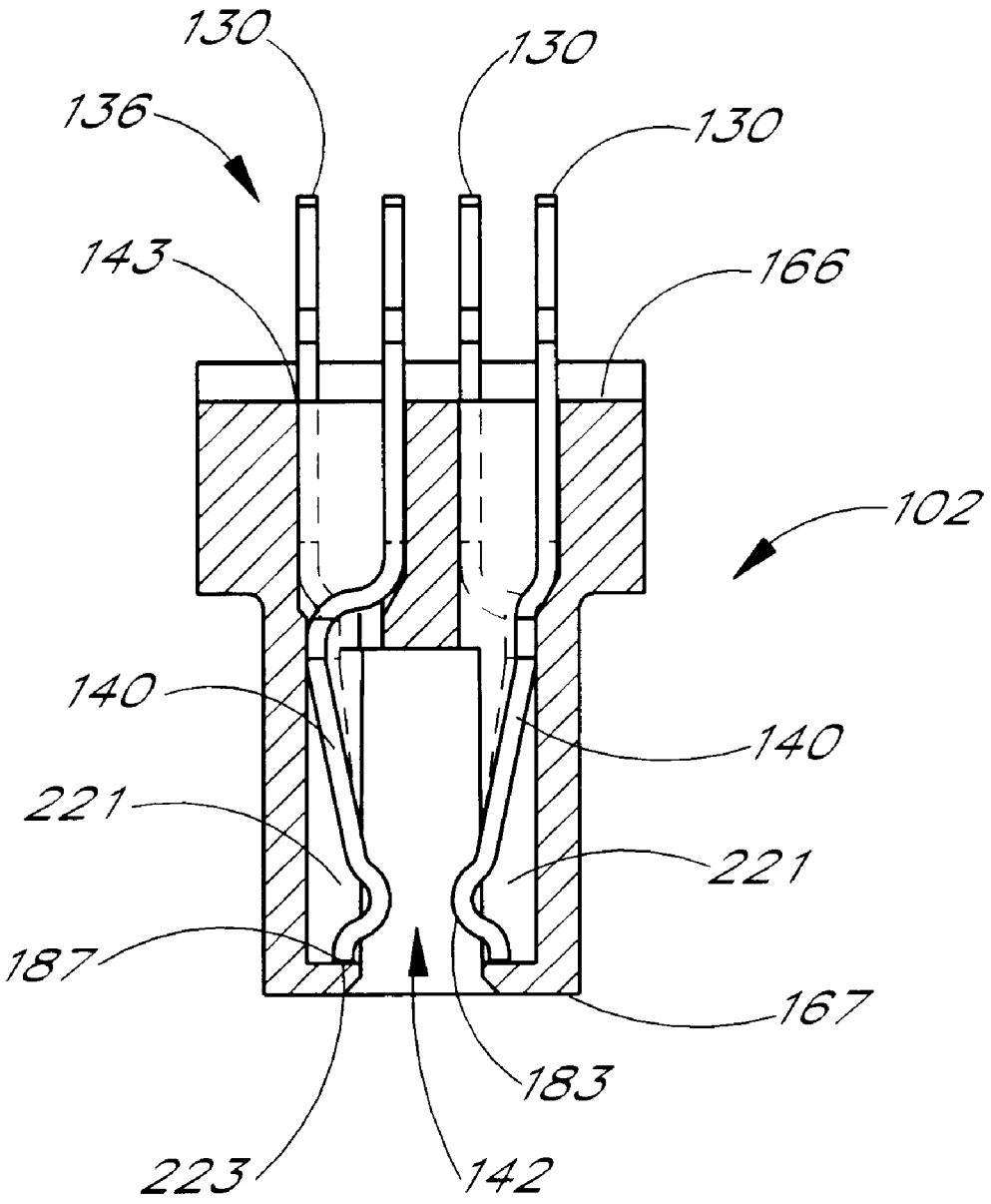
FIG. 9 is an isometric view illustrating the configuration of the plurality of contacts as it is positioned within the base and the retainer of the connector of FIG. 1.

FIG. 9 further illustrates the plurality of contacts 130 as they are positioned in the base 102. In particular, FIG. 9 illustrates that the insulation displacement ends 134 of the plurality of contacts 130 are positioned within the openings 142 so as to extend out from the inner surface 166 of the base 102. Four adjacent contacts 130 are shown in FIG. 9 to illustrate that the insulation displacement ends 134 of adjacent contacts 130 are offset from each other in the above-described manner.

The mating sections 140 of the plurality of contacts 130 extend into the opening 143 so as to be able engage with an external printed circuit board or mating connector that is inserted into the opening 142. Specifically, the mating sections 140 are respectively positioned within grooves 221 formed in the inner walls of the base 102 so that the contact surface 183 faces into the opening 142. The upper end 187 of the mating section 140 preferably engages with a lip 223 formed adjacent the outer surface 167 of the base 102 so that the mating sections 140 are captured within the grooves 221. As discussed above, the mating sections 140 are preferably bent so as to extend into the opening 143 to thereby be biased inward to ensure that the contact face 183 makes good electrical contact with the mating connector or printed circuit board.

It will be appreciated that the connector 100 of the preferred embodiment is simpler to assemble as the contacts 130 are arranged so that a single carrier 180 attached to a single row of mating sections 140 of the contacts 130 is connected to two offset rows of insulation displacement ends 134. Hence, the assembly step of positioning the plurality of contacts 130 into the retainer 106 is simplified as only one-half as many rows of contacts 130 have to be positioned within the retainer or like components. Similarly, it will be appreciated by a person of skill in this art that the plating costs associated with plating contacts having this configuration is lowered as a result of more individual contacts being positioned on a single linear strip of contacts.

It will also be appreciated that the accuracy and reliability of the connector of the preferred embodiment is improved over similar connectors of the prior art. In particular, the plurality of contacts are captured within a retainer and the retainer and a cover are configured to compress the high density cable so as to center cables within an opening that is defined by indentations on the retainer and cover. The compression occurs while the insulation displacement ends of the contacts are being urged into the opening defined by the indentations on the cover and the retainer. Hence, compressing the cover to the base with the retainer and the ribbon cable interposed therebetween simultaneously centers the conductors of the ribbon cable in the space while urging the blades of the contacts through the insulation to make electrical contact with selected conductors of the ribbon cable.

Although the preferred embodiment of the present invention has shown, described and pointed out the fundamental novel features of the invention as applied to these embodiments, it will be understood that various omissions, substitutions, and changes in the form of the detail of the device illustrated may be made by those skilled in the art without departing from the spirit of the present invention. Consequently, the scope of the invention should not be limited to the foregoing description but should be defined by the appended claims.

What is claimed is:

1. A connector for a multi-conductor ribbon cable that has a plurality of conductors, the connector comprising:

a plurality of contacts that have a first end that is configured to be electrically connected to conductors within the ribbon cable and a second end that provides a contact point for external contacts to make electrical connection with the plurality of conductors in the ribbon cable via the plurality of contacts;

a base member having a first surface wherein at least one opening is formed in the first surface that receives the second ends of the plurality of contacts and maintains the plurality of contacts in a fixed relationship relative to each other with the first ends of the plurality of contacts extending outward from the first surface;

a cover member that is detachably engaged with the base member; and a retainer that is interposed between the cover member and the base member wherein the retainer has a plurality of openings extending therethrough which receive the first ends of the plurality of contacts and maintains the first ends in a pre-defined fixed pattern with respect to each other and wherein the retainer and the cover member define a ribbon cable receiving area and the retainer and cover member are adapted to precisely locate individual conductors in the ribbon cable into a desired orientation with respect to the openings in the retainer when the cover and retainer are compressed together wherein the base member and the retainer are engaged so that compression of the cover member and the retainer simultaneously precisely orient the individual conductors with respect to the openings in the retainer and urge the first ends of the plurality of contacts into the conductors so that the first ends of the plurality of contacts are positioned within pre-determined conductors within the ribbon cable.

2. The connector of claim 1, wherein indentations are formed in both the cover member and the retainer and wherein the indentations, fit around the insulation surrounding each conductor within the ribbon cable so that when the cover member is positioned adjacent to the retainer, the indentations respectively center the conductors within the space defined by the indentations on the cover member.

3. The connector of claim 2, wherein the first ends of the plurality of contacts is comprised of an insulation displacement end that pierces the insulations surrounding the conductors and makes electrical connection with the conductors in the ribbon cable.

4. The connector of claim 3, wherein the plurality of contacts are comprised of contacts that have:

an insulation displacement end pierces the insulation surrounding the conductors in the multi-conductor ribbon cable and make electrical connection to the conductor;

a mating section that is positioned within the base section that defines a contact face accessible to the external contact for electrical connection thereto; and a central section interposed between the insulation displacement end and the mating section, wherein the central section includes a chamfer.

5. The connector of claim 4, wherein a first set of the plurality of contacts further comprises a bent section that is interposed between the insulation displacement end and the mating end so that the insulation displacement ends of the first set of contacts are spaced in a first direction from the location of the second ends.

6. The connector of claim 5, wherein every other contact in the plurality of contacts is comprised of a contact in the first set.

7. The connector of claim 4, wherein the at least one opening in the base member that receive the second ends of the plurality of contacts defines a lip that exerts a force against the chamfer so as to urge the insulation displacement ends of the contacts into the ribbon cable when the base, retainer and cover are compressed together.

8. The connector of claim 7, wherein the plurality of openings in the retainer defines a lip that makes contact with the chamfer to prevent over insertion of the insulation displacement ends of the plurality of contacts into the plurality of conductors.

9. The connector of claim 8, wherein the interface between the central section and the mating section of the plurality of contacts define a lip and wherein the at least one opening defines a stop that engages with the lip on the plurality of contacts and urges the plurality of contacts into the ribbon cable during compression of the cover to the base member.

10. The connector of claim 1, wherein the plurality of contacts is comprised of two sets of contacts wherein the first ends of each set of contacts are arranged into two separate parallel rows.

11. The connector of claim 10, wherein the plurality of contacts are comprised of two sets of thirty four contacts with two parallel rows of thirty four first ends and four parallel lines of seventeen second ends.

12. A connector for a multi-conductor ribbon cable that has a plurality of conductors, the connector comprising:

a plurality of contacts that have a first end that is configured to be electrically connected to conductors within the ribbon cable and a second end that provides a contact point for external contacts to make electrical connection with the plurality of conductors in the ribbon cable via the plurality of contacts wherein the plurality of contacts are initially attached to a single removable carrier that is attached to the second ends of the plurality of contacts prior to installation into the base and wherein the plurality of contacts are configured so that the second ends of the plurality of contacts are arranged into a single row and the first ends of the plurality of contacts are arranged into two parallel rows when the plurality of contacts are attached to the removable carrier;

a base member having a first surface wherein at least one opening is formed in the first surface that receives the second ends of the plurality of contacts and maintains the plurality of contacts in a fixed relationship relative to each other with the first ends of the plurality of contacts extending outward from the first surface;

a retainer that is positioned adjacent the first source of the base member, wherein the retainer includes two rows of openings extending therethrough adapted to receive the first ends of the plurality of contacts while the plurality of contacts are attached to the single removable carrier and wherein the removable carrier is adapted to be removed from the plurality of contacts after the first ends of the plurality of contacts are positioned in the retainer to thereby allow the second ends of the plurality of contacts to be received by the first surface of the base member; and a cover member that is detachably engaged with the base member wherein the cover member defines a ribbon cable receiving area and is configured so that, when the cover member is engaged with the base member and the ribbon cable is positioned in the ribbon cable receiving area, the conductors of the ribbon cable are positioned adjacent the openings of the retainer so that the first ends of the plurality of contacts are urged through the openings in the retainer so as to make electrical contact with the conductors in the ribbon cable.

13. The connector of claim 12, wherein the base member defines a second surface and at least one opening is formed in the second surface to thereby provide access for the external contacts to the second ends of the plurality of contacts that are positioned in the base member.

14. The connector of claim 13, wherein the at least one opening in the first surface of the base member is comprised of a plurality of openings that receive the second ends of the plurality of contacts.

15. The connector of claim 12, wherein the cover member and the retainer collectively define a ribbon cable receiving area and wherein the cover member and the retainer is adapted to center individual conductors in the ribbon cable into a desired orientation with respect to the openings in the retainer when the cover and the retainer are compressed together so that the first ends of the plurality of contacts are positioned within predetermined conductors within the ribbon cable.

16. The connector of claim 15, wherein indentations are formed in both the cover member and the retainer and wherein the indentations fit around the insulation surrounding each conductor within the ribbon cable so that when the cover member is positioned adjacent the retainer, the indentations respectively center the conductors within the space defined by the indentations on the cover member and the retainer.

17. The connector of claim 16, wherein the first ends of the plurality of contacts is comprised of an insulation displacement end that pierces the insulation surrounding the conductors and make electrical connection with the conductors in the ribbon cable.

18. The connector of claim 17, wherein the plurality of contacts are comprised of contacts that have:

an insulation displacement end pierces the insulation surrounding the conductors in the multi-conductor ribbon cable and make electrical connection to the conductor;

a mating section that is positioned within the base section that defines a contact face accessible to the external contact for electrical connection thereto; and a central section interposed between the insulation displacement end and the mating section, wherein the central section includes a chamfer.

19. The connector of claim 18, wherein a first set of the plurality of contacts further comprises a bent section that is interposed between the insulation displacement end and the mating end so that the insulation displacement ends of the first set of contacts are spaced in a first direction from the location of the second ends.

20. The connector of claim 19, wherein every other contact in the plurality of contacts is comprised of a contact in the first set.

21. The connector of claim 20, wherein the at least one opening in the base member that receive the second ends of the plurality of contacts defines a lip that exerts a force against the chamfer so as to urge the insulation displacement ends of the contacts into the ribbon cable.

22. The connector of claim 21, wherein the plurality of openings in the retainer defines a lip that makes contact with the chamfer to prevent over insertion of the insulation displacement ends of the plurality of contacts into the plurality of conductors.

23. The connector of claim 21, wherein the interface between the central section and the mating section of the plurality of contacts define a lip and wherein the at least one opening defines a stop that engages with the lip on the plurality of contacts and urges the plurality of contacts into the ribbon cable during compression of the cover to the base member.

24. The connector of claim 12, wherein the plurality of contacts is comprised of two sets of contacts wherein the first ends of each set of contacts are arranged into two separate parallel rows.

25. The connector of claim 24, wherein the plurality of contacts are comprised of two sets of thirty four contacts with two parallel rows of thirty four first ends and four parallel lines of seventeen second ends.

26. A connector for a multi-conductor ribbon cable that has a plurality of conductors, the connector comprising:

a plurality of contacts that have a first end that is configured to be electrically connected to conductors within the ribbon cable and a second end that provides a contact point for external contacts to make electrical connection with the plurality of conductors in the ribbon cable via the plurality of contacts wherein each of the plurality of contacts have at least one tab formed thereon;

a base member having a first surface wherein at least one opening is formed in the first surface that receives the second ends of the plurality of contacts and maintains the plurality of contacts in a fixed relationship relative to each other with the first ends of the plurality of contacts extending outward from the first surface;

a cover member that is detachably engaged with the base member; and a retainer that is interposed between the cover member and the base member wherein the retainer has a plurality of openings extending therethrough which receive the first ends of the plurality of contacts and maintains the first ends in a pre-defined fixed pattern with respect to each other and wherein the retainer and the cover member define a ribbon cable receiving area and the retainer and cover member are adapted to precisely locate individual conductors in the ribbon cable into a desired orientation with respect to the openings in the retainer when the cover and retainer are compressed together so that the first ends of the plurality of contacts are positioned within pre-determined conductors within the ribbon cable and wherein the tab on the each of the plurality of contacts engage with the openings in the retainer so as to stabilize the retainer in a first orientation during compression of the cover and retainer.

27. The connector of claim 26, wherein indentations are formed in both the cover member and the retainer and wherein the indentations fit around the insulation surrounding each conductor within the ribbon cable so that when the cover member is positioned adjacent the retainer, the indentations respectively center the conductors within the space defined by the indentations on the cover member and wherein the tab permits greater compressive force to be exerted between the cover and the retainer while maintaining the retainer in the first orientation.

28. The connector of claim 27, wherein the first ends of the plurality of contacts is comprised of an insulation displacement end that pierces the insulations surrounding the conductors and makes electrical connection with the conductors in the ribbon cable.

29. The connector of claim 28, wherein the plurality of contacts are comprised of contacts that have:

an insulation displacement end pierces the insulation surrounding the conductors in the multi-conductor ribbon cable and make electrical connection to the conductor;

a mating section that is positioned within the base section that defines a contact face accessible to the external contact for electrical connection thereto; and a central section interposed between the insulation displacement end and the mating section, wherein the central section includes a chamfer and wherein the at least one tab is positioned so as to be adjacent an outer edge of the central section.

30. The connector of claim 29, wherein a first set of the plurality of contacts further comprises a bent section that is interposed between the insulation displacement end and the mating end so that the insulation displacement ends of the first set of contacts are spaced in a first direction from the location of the second ends.

31. The connector of claim 30, wherein every other contact in the plurality of contacts is comprised of a contact in the first set.

32. The connector of claim 29, wherein the at least one opening in the base member that receive the second ends of the plurality of contacts defines a lip that exerts a force against the chamfer so as to urge the insulation displacement ends of the contacts into the ribbon cable when the base, retainer and cover are compressed together.

33. The connector of claim 32, wherein the plurality of openings in the retainer defines a lip that makes contact with the chamfer to prevent over insertion of the insulation displacement ends of the plurality of contacts into the plurality of conductors.

34. The connector of claim 33, wherein the interface between the central section and the mating section of the plurality of contacts define a lip and wherein the at least one opening defines a stop that engages with the lip on the plurality of contacts and urges the plurality of contacts into the ribbon cable during compression of the cover to the base member.

35. The connector of claim 26, wherein the plurality of contacts is comprised of two sets of contacts wherein the first ends of each set of contacts are arranged into two separate parallel rows.

36. The connector of claim 35, wherein the plurality of contacts are comprised of two sets of thirty four contacts with two parallel rows of thirty four first ends and four parallel lines of seventeen second ends.

* * * * *